US007128489B2

(12) United States Patent
Paillot et al.

(10) Patent No.: US 7,128,489 B2
(45) Date of Patent: Oct. 31, 2006

(54) WRITING INSTRUMENT

(75) Inventors: Nicolas Paillot, Neuilly sur Seine (FR); Pedro Antonio Perez del Pino, Tarragona (ES)

(73) Assignee: Societe BIC, Clichy (FR)

( * ) Notice: Subject to any disclaimer, the term of this patent is extended or adjusted under 35 U.S.C. 154(b) by 0 days.

(21) Appl. No.: 11/152,739

(22) Filed: Jun. 13, 2005

(65) Prior Publication Data

US 2006/0024120 A1 Feb. 2, 2006

Related U.S. Application Data

(63) Continuation of application No. PCT/EP03/10872, filed on Oct. 1, 2003.

(30) Foreign Application Priority Data

Dec. 13, 2002 (EP) ..... 02027949

(51) Int. Cl.
*B43K 5/16* (2006.01)

(52) U.S. Cl. ..... 401/112; 401/109

(58) Field of Classification Search ..... 401/104, 401/105, 106, 109, 112; 200/523, 524, 525
See application file for complete search history.

(56) References Cited

U.S. PATENT DOCUMENTS

| | | | | |
|---|---|---|---|---|
| 3,432,244 | A | 3/1969 | Bross | |
| 5,145,272 | A | 9/1992 | Keil | |
| 6,390,706 | B1 * | 5/2002 | Yokouchi et al. | 401/104 |
| 6,390,707 | B1 * | 5/2002 | Kageyama et al. | 401/104 |

* cited by examiner

*Primary Examiner*—David J. Walczak
(74) *Attorney, Agent, or Firm*—Jones Day

(57) ABSTRACT

A writing instrument that includes a sleeve-like housing, a reservoir axially extending in the housing, a push button positioned in the rear portion of the housing, a latching device for latching the push button in a writing position with a latch recess in the housing and a latch lug positioned at the free end of a transversely elastically bendable spring arm extending from the push button. The writing instrument also includes a shift device for releasing the latching device and returning the latch lug into a parking position, and a support member disposed at the push button that includes a support surface which stops the latch lug from lateral movement into the latch recess when being moved back from a position moved forward beyond the writing position. In order to enhance the arrangement of the support member in the writing instrument, the support member is disposed at a peripheral wall portion of the push button.

9 Claims, 3 Drawing Sheets

WRITING INSTRUMENT

This application is a continuation of PCT Application No. PCT/EP03/10872, filed on Oct. 1, 2003, which claims priority to European Patent Application 02 027 949.3, filed on Dec. 13, 2002. The entire contents of these two applications is expressly incorporated herein.

The invention relates to a writing instrument, in particular, to a ballpoint pen.

A writing instrument of this type is distributed on the market by the applicant under the term "Media Clic" and is thus believed to be a state-of-the-art device.

SUMMARY OF THE INVENTION

An embodiment of the present invention includes a push button disposed in the rear portion, that is to say in the end portion of the writing instrument facing away from the writing end, and is mounted axially displaceable in the sleeve-like housing of the writing instrument so as to be secured against pivoting. A reservoir is supported on the reverse side by the force of a spring. By manually pushing forward the push button, the reservoir can be shifted into a writing position, in which the push button is automatically latched at the housing by a latching device and is thus fixed against retraction in order to be able to perform a writing function with the writing instrument. The latching device is constituted by a zigzag-shaped guide groove in the wall of the housing and a latch lug guided so as to be displaceable therein. The latch lug is positioned at a free end of a spring arm extending substantially parallel to the axis and mounted on the push button and is first shifted into a peripheral direction when the push button is pushed forward in the zigzag-shaped guide groove, and bounces back into a central position at the end of the zigzag-shaped guiding groove and latches the push button against retraction.

For releasing the latching device, a shift device is provided, which automatically unlatches the latch lug in case of further manual pushing forward of the push button out of the latching position. After releasing the push button, the spring force can push the push button and the latch lug back into their original position. In order to avoid (in the event of retraction from an unlatching position pushed further forward) that the latch lug re-immerses into the zigzag-shaped guiding groove and latches at its front end, what is provided at the push button is a support member having an oblique support surface, with respect to which the latch lug, when immersing into the opposed peripheral direction in the forward movement out of the latching position, is laterally displaced such that, when being moved back, the latch lug cannot bounce into its original position at the front end of the zigzag-shaped guiding groove by but only at the rear end of the guide groove.

In an embodiment of the present invention, the support member is provided on a base of the push button, which is positioned in the central portion of the push button and forms a boundary surface for a receiving shaft for the rear end of the reservoir with its face directed forward. This results in a difficult construction requiring high material expenditure.

An object of an embodiment of the present invention includes improving a writing instrument in regard to the arrangement of the support member by shifting the support member's support into the peripheral portion of the push button.

In the writing instrument according to an embodiment of the present invention, the support member is disposed and supported at a peripheral wall portion of the push button, which is situated radially outside a central free space in the push button. The support member is thus supported by a peripheral wall or a peripheral wall portion of the push button. This results in a simple shape, which can easily be manufactured particularly as an injection molded part, since no supporting wall extending transversely in the center of the push button is required.

Another object of an embodiment of the present invention is that no material is present in the central portion of the push button and therefore less material is required. This also results in a reduction in weight and lower production costs.

Yet another object of an embodiment of the present invention is that a free space can be used as receiving space for the reservoir and that a cross-section of the free space greater than the cross-section of the reservoir can be designed, so that the reservoir can be inserted with play of movement. As a result, the receiving shaft for the reservoir can be axially prolonged beyond the support member, so that the writing instrument is suitable for longer reservoirs and therefore reservoirs having a greater filling for writing material and having a longer term of use can be utilized.

In another embodiment of the present invention, the support surface can be easily designed as an axial transverse surface of the peripheral wall portion, which borders a hole in the peripheral wall, into which the latching lug immerses when the push button is pushed further forward from its latching position and the latching lug immerses into the recess. In such an embodiment, in its immersed position, the latching lug is laterally supported towards the side on which the zigzag-shaped guide groove is located. The lateral support, in a form-fit fashion, prevents the latching lug from unintentionally bouncing into the guide groove when moving back into its original position.

Moreover, other embodiments of the present invention lead to simple and favorably spaced configurations both in the area of the sleeve portion supporting the supporting surface and in the area of the latching lug whose special shape ensures good operation and a long lifetime in spite of unavoidable wear between the latching lug and the guide groove.

DETAILED DESCRIPTION OF THE PREFERRED EMBODIMENTS

Figure 1:
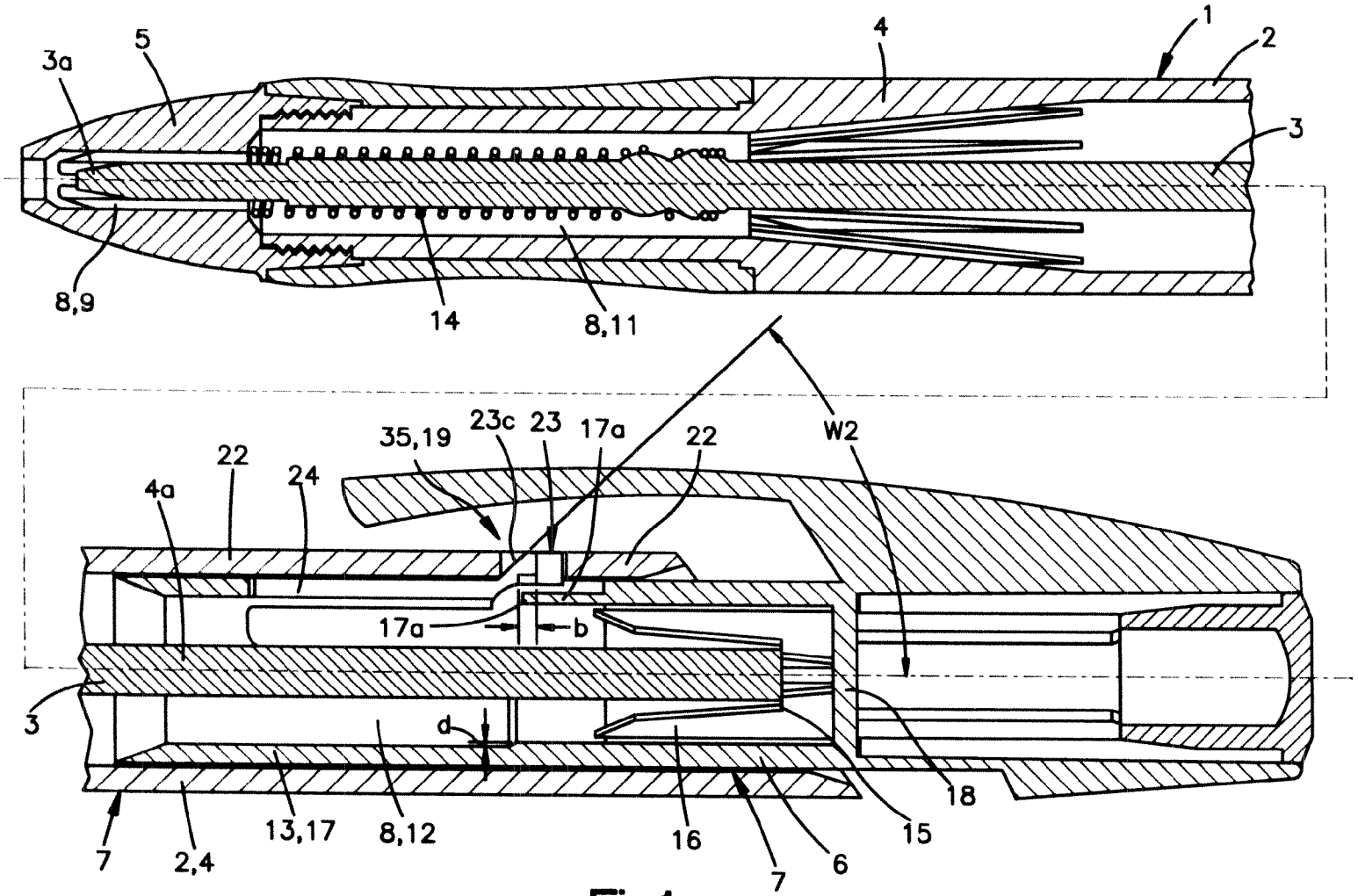
FIG. 1 is a longitudinal sectional view of a writing instrument according to an embodiment of the present invention.
Figure 2:
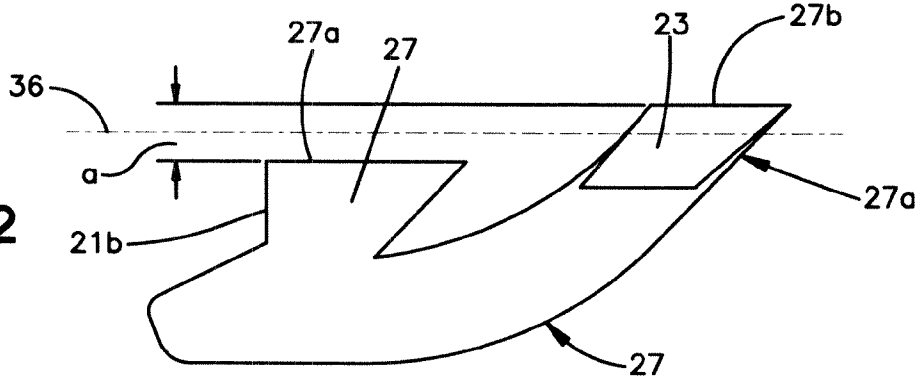
FIG. 2 is a top view of the guide groove.

The writing instrument 1 includes a pen-shaped housing 2 and a reservoir 3 received therein.

The housing 2 includes a grip sleeve 4 that is preferably screwed at its front end to a dome 5 and is closed at its rear end by a push button 6. The push button 6 is associated in an axially displaceable fashion with the grip sleeve 4 by a guide member 7. The reservoir 3 is located in a reservoir shaft 8, which penetrates the dome 5 in the form of a tapered longitudinal hole 9, is constituted by the hollow space 11 of the grip sleeve 4 and extends in its rear end portion as reservoir hole 12 into the push button 6.

In a preferred embodiment, the push button has a sleeve-like guide shaft 13, whose cross-section and, e.g., circular shape is adapted with play of movement to the inner cross-sectional size and shape of the grip sleeve 4, is inserted in the grip sleeve 4 and axially displaceable therein. The reservoir 3 is biased towards the rear by a spring 14, preferably a surrounding spiral spring, the spring's rear end portion extends into a central free space. Radial webs 16 preferably extend radially inwards from the sleeve wall 17 of the guide shaft 13. The reservoir 3 can also have a greater cross-section, e.g., can be adapted to the cross-section of the reservoir hole 12, the webs 16 can be missing, and a hole wall 18 bordering the reservoir hole 12 can serve as a shoulder surface to support the resevoit 3 at the back. The front end of the spring 14 is supported on the dome 5.

By manually pushing the push button 6 forward, the reservoir 3 can be displaced from the represented rear parking position into a front writing position, in which the reservoir tip 3*a* protrudes from the dome 5 and the push button 6 is latched against retraction by a latching device 19 at the grip sleeve 4.

The latching device 19 is constituted by a latch recess 21 in the sleeve wall 22 of the grip sleeve 4 and a latch lug 23 spring-movably arranged at the push button 6, which automatically latches into the latch recess 21 on account of the elastic force of the spring. The latch lug 23 is positioned on the free end of a spring arm 24 extending approximately parallel to the axis, which is part of the push button sleeve wall 17 and is formed by wall recesses 25, 26 provided at its two sides.

The latch recess 21 is part of a zigzag-shaped guiding groove 27, whose rear groove end constitutes a parking recess 27*a* and whose front groove end constitutes the latch recess 21. The lateral boundary wall 21*a* of the latch recess 21 can be laterally displaced with respect to the boundary wall 27*b* of the parking recess 27*a* towards the guide groove 27 by the measure "a", e.g., preferably by about one to two mm. To the front, the latch recess 21 is limited by a boundary wall 21*b* extending transversely, preferably at right angles, to the longitudinal axis of the grip sleeve 4.

Figure 3:
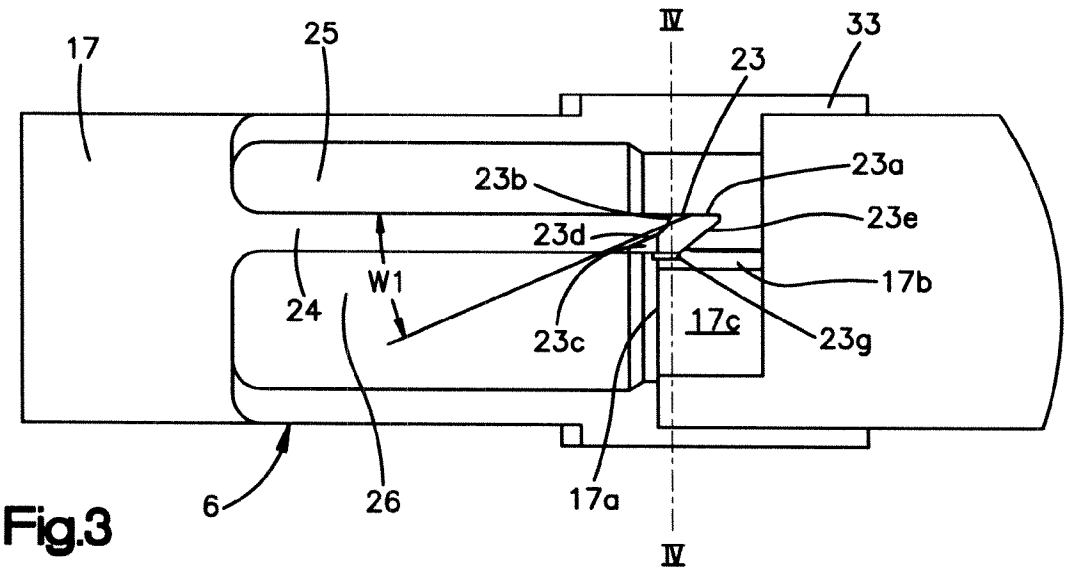
FIG. 3 is a top view of the push button.

The latch lug 23 protruding outwards from the spring arm 24 is adapted to the shape of the rear end portion of the parking recess 27*a* of the guide groove 27 as far as its cross-sectional shape is concerned, i.e., it has an axial side surface 23*a* on the right-hand side (when seen from the back to the front) encloses an acute angel W1 of approximately 25° to 35° with a prolongation of the side surface 23*a* directed forward and to which a free surface 23*b* extending at an acute angle towards the other side in the central portion of the latch lug 23 extends to a transversely extending front surface 23*c*, which is inclined backwards and encloses an acute angel W2 of, e.g., approximately 45° with the longitudinal central axis 4*a* of the grip sleeve. The edge between the free surface 23*b* and the front surface 23*c* can be broken by a curved portion or by an edge rupture surface 23*d*. The back surface 23*e* is inclined forward substantially parallel to the free surface 23*b* and terminates in a rearward directed distance "b" from the front end of a sleeve wall portion 17*a*, which extends into the U-shaped recess 33 from the back and/or from the left-hand side in FIG. 3. In the peripheral direction directed to the right, the sleeve wall portion 17*a* has a support surface 17*b* extending parallel to the axis, which encloses an acute angle W3 with the longitudinal central plane E1 of the grip sleeve 4 extending transversely to the radial direction of movement 28 of the latch lug 23; the angle W3 can amount to approximately 30° to 60° and is about 45° in a preferred embodiment. At the outer side, the sleeve wall portion 17*a* can be flattened by a secantially extending free surface 17*c*, with the support surface 17*b* being limited to the inner portion of the sleeve wall portion 17*a*. In a preferred embodiment, the radially outer boundary edge 17*a* of the support surface 17*b* is approximately in the longitudinal central plane E2 extending at right angles to E1, with the latch lug 23 being displaced relative to the longitudinal central plane E2 so far outside the center-in a preferred embodiment to the right hand side-that it is at a radial distance with its lower border 23*f* facing the longitudinal central plane E2 in its relaxed position radially above the support surface 17*b*, preferably in its central area.

From the inclined back surface 23*e*, the latch lug 23 has a lateral projection 23*g*, which is in the inner portion of its side surface above the support surface 17*b* and whose side surface 23*h* can enclose, with the longitudinal central plane E2, an acute angle W4 which is open towards the inside and which can be, e.g., about 10 to 15°. At the upper border of the opposing side, the latch lug 23 can have a lateral projection 23*g*.

Figure 4:
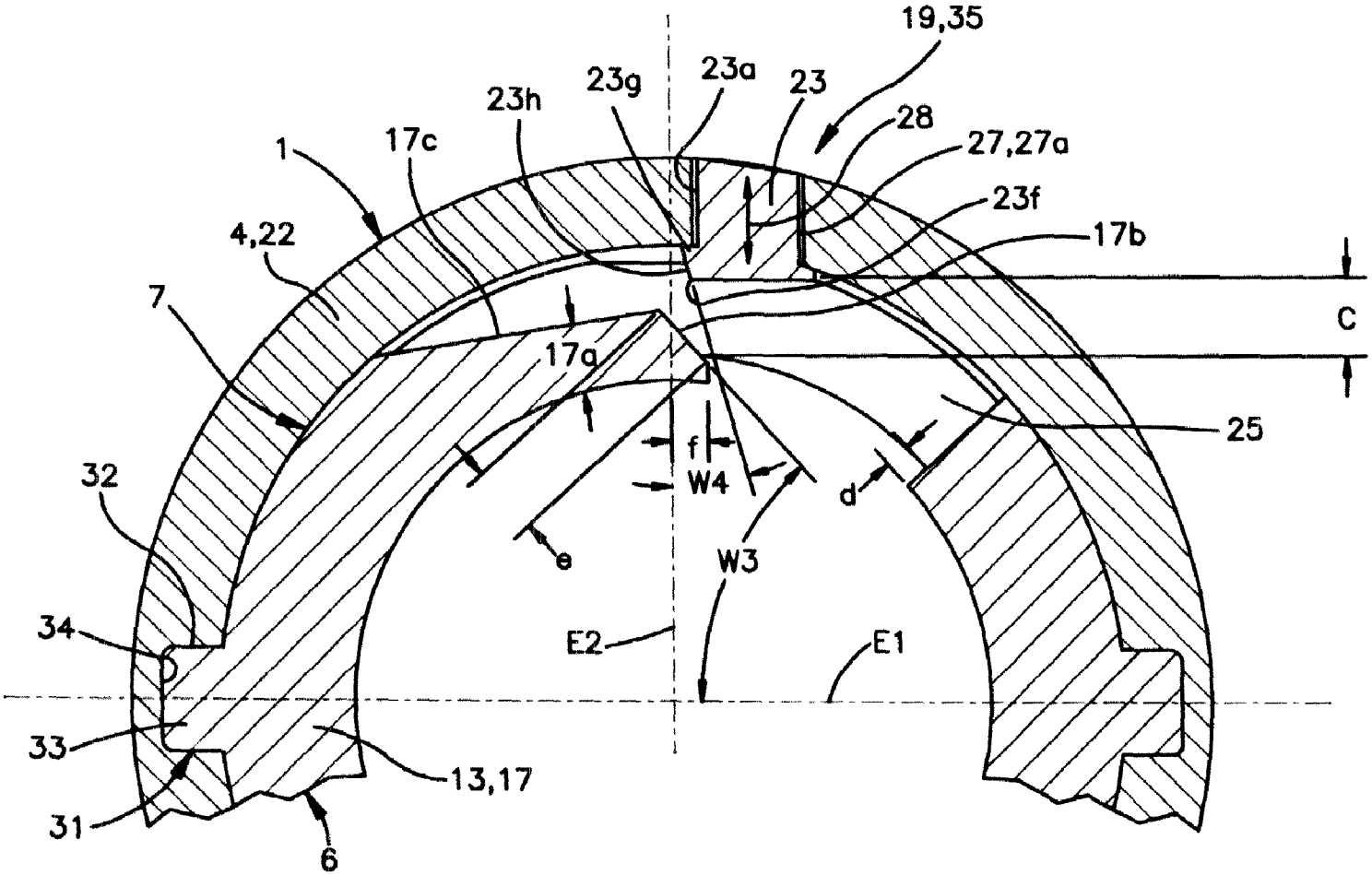
FIG. 4 is a cross-sectional view IV—IV shown in FIG. 3.

In a preferred embodiment, the sleeve wall portion 17*a* extends in a longitudinal portion of the reservoir hole 12, whose cross-section is tapered. The difference in thickness is identified by "d" in FIGS. 1 and 4. Therefore, the sleeve wall portion 17*a* projects inwards from the untapered longitudinal section of the reservoir hole 12 by the distance d. As a result thereof, a support surface 17*b* having a greater transverse dimension e can be achieved. In a preferred embodiment, the sleeve wall portion 17*a* protrudes the longitudinal central plane E2 by the distance f.

The push button 6 is secured against pivoting by a pivot lock 31 in the grip sleeve 4 and can be displaced longitudinally in doing so. The pivot lock 31 can be put into effect by a groove/pin engagement 32 on one or on both sides between the push button 6 and the grip sleeve 4. In a preferred embodiment, what projects from the push button 6 on both sides are guiding webs 33, which extend parallel to the axis, which are located in the inner wall surface of the sleeve wall 22 in guiding grooves 34 extending in parallel with play of movement and which are open on the reverse side, so that the push button 6 can be inserted with the guiding webs 33 from behind. Therefore, it is ensured that the latch lug 23 is positioned in the peripheral direction with respect to the guiding groove 27.

The latching device 19 is combined with a shift device 35, which enables that the latching device 19 is released and the push button 6 is retracted with the reservoir 3 from the latching position into the parking position. For performing the releasing step, the push button is pushed forward manually from the latching position, the latching lug 23 hitting against the boundary wall 21*b* with its front surface 23*c* and thus being moved radially inwards; in doing so, it impinges upon the laterally effective support surface 17*b* and is displaced there towards the side facing away from the guide groove 27 far enough to be on a line parallel to the axis, which is beside the latch recess 21, so that, when the push button 6 is moved back by the force of the spring 14, the latch lug 23 is guided beside the latch recess 21 at the inner surface of the sleeve wall 2 and reaches the parking position without immersing into the latch recess 21, in which position it bounces back into the parking recess 27*a*. The line 36 extending parallel to the axis cuts the parking recess 27*a* and the latch lug 23 centrally, so that it is ensured that the latch lug 23 bounces in automatically.

It is also possible to arrange the support surface 17*b* such that the latch lug 23 automatically bounces into the area of the line 36 due to the lateral bending out of the spring arm 24 by the displacement "a" when pushing forward the push button immersing the latch lug 23. The support surface 17*b* can be arranged in a position so as to prevent lateral movement of the latch lug 23 towards the latch recess 21 by a stop, when the push button 6 is moved back into the parking position from the pushed forward position.

This specification is not intendded to limit the scope of the claims to any of the embodiments of the invention described above.

What is claimed is:

1. A writing instrument, comprising:

a sleeve-like housing;

a reservoir axially extending in said housing;

a push button positioned in a rear portion of said housing and mounted in said housing to be manually displaceable in a fashion to be secured against pivoting with said reservoir between a rear parking position and a front writing position and biased in the parking position by a force of a spring;

a latching device for latching said push button in the writing position with a latch recess in said housing and a latch lug positioned at a free end of a transversely elastically bendable spring arm extending from said push button;

a shift device for releasing said latching device and returning the latch lug into the parking position;

and a support member positioned at said push button that includes a support surface that bars the latch lug by a stop from lateral movement into the latch recess when being moved back from a position moved forward beyond the latching position, wherein said support member is disposed at a peripheral wall portion of said push button, which is located radially outside a central free space of said push button, and wherein the peripheral wall portion protrudes radially inwards, another peripheral wall portion of said push button extending forward therefrom.

2. A writing instrument according to claim 1, wherein the peripheral wall portion is part of a sleeve-like peripheral wall of said push button.

3. A writing instrument, comprising:

a sleeve-like housing;

a reservoir axially extending in said housing;

a push button positioned in a rear portion of said housing and mounted in said housing to be manually displaceable in a fashion to be secured against pivoting with said reservoir between a rear parking position and a front writing position and biased in the parking position by a force of a spring;

a latching device for latching said push button in the writing position with a latch recess in said housing and a latch lug positioned at a free end of a transversely elastically bendable spring arm extending from said push button;

a shift device for releasing said latching device and returning the latch lug into the parking position;

and a support member positioned at said push button that includes a support surface that bars the latch lug by a stop from lateral movement into the latch recess when being moved back from a position moved forward beyond the latching position, wherein said support member is disposed at a peripheral wall portion of said push button, which is located radially outside a central free space of said push button, and wherein the support surface is constituted by a transverse surface of the peripheral wall portion extending approximately parallel to an axis.

4. A writing instrument according to claim 1, wherein the support surface is constituted by a free face of the peripheral wall portion.

5. A writing instrument according to claim 4, wherein the support surface extends in an inclined or oblique fashion relative to the peripheral direction.

6. A writing instrument according to claim 5, wherein the support surface encloses an acute angle of approximately 45°, having a longitudinal central plane extending substantially at right angels to the latching and unlatching movement of the latch lug.

7. A writing instrument according to claim 6, wherein the peripheral wall portion is flattened on an exterior surface.

8. A writing instrument, comprising:

a sleeve-like housing;

a reservoir axially extending in said housing;

a push button positioned in a rear portion of said housing and mounted in said housing to be manually displaceable in a fashion to be secured against pivoting with said reservoir between a rear parking position and a front writing position and biased in the parking position by a force of a spring;

a latching device for latching said push button in the writing position with a latch recess in said housing and a latch lug positioned at a free end of a transversely elastically bendable spring arm extending from said push button;

a shift device for releasing said latching device and returning the latch lug into the parking position;

and a support member positioned at said push button that includes a support surface that bars the latch lug by a stop from lateral movement into the latch recess when being moved back from a position moved forward beyond the latching position, wherein said support member is disposed at a peripheral wall portion of said push button, which is located radially outside a central free space of said push button, wherein the support surface is constituted by a free face of the peripheral wall portion, wherein the support surface extends in an inclined or oblique fashion relative to the peripheral direction, wherein the support surface encloses an acute angle of approximately 45°, having a longitudinal central plane extending substantially at right angels to the latching and unlatching movement of the latch lug, wherein the peripheral wall portion is flattened on an exterior surface, and wherein the peripheral wall portion is flattened by a secantial free surface.

9. A writing instrument, comprising:

a sleeve-like housing;

a reservoir axially extending in said housing;

a push button positioned in a rear portion of said housing and mounted in said housing to be manually displaceable in a fashion to be secured against pivoting with said reservoir between a rear parking position and a front writing position and biased in the parking position by a force of a spring;

a latching device for latching said push button in the writing position with a latch recess in said housing and a latch lug positioned at a free end of a transversely elastically bendable spring arm extending from said push button;

a shift device for releasing said latching device and returning the latch lug into the parking position;

and a support member positioned at said push button that includes a support surface that bars the latch lug by a stop from lateral movement into the latch recess when being moved back from a position moved forward beyond the latching position, wherein said support member is disposed at a peripheral wall portion of said push button, which is located radially outside a central free space of said push button, wherein said support member is disposed at a peripheral wall portion of said push button, which is located radially outside a central free space of said push button, wherein the support surface is constituted by a free face of the peripheral wall portion, wherein the support surface extends in an inclined or oblique fashion relative to the peripheral direction, wherein the support surface encloses an acute angle of approximately 45°, having a longitudinal central plane extending substantially at right angels to the latching and unlatching movement of the latch lug, wherein the peripheral wall portion is flattened on an exterior surface, wherein the peripheral wall portion is flattened by a secantial free surface, and wherein the peripheral wall portion protrudes from a longitudinal central plane extending parallel to the latching and unlatching movement of the latch lug.

* * * * *